US006434084B1

(12) United States Patent
Schultz

(10) Patent No.: US 6,434,084 B1
(45) Date of Patent: Aug. 13, 2002

(54) ADAPTIVE ACOUSTIC CHANNEL EQUALIZER & TUNING METHOD

(75) Inventor: Roger L. Schultz, Denton, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/444,947

(22) Filed: Nov. 22, 1999

(51) Int. Cl.[7] ..... H04H 9/00

(52) U.S. Cl. ..... 367/81; 367/82; 340/854.4; 340/855.4; 340/855.6

(58) Field of Search ..... 367/81, 83, 82; 340/853.1, 854.9, 854.4, 855.4, 855.6

(56) References Cited

U.S. PATENT DOCUMENTS

| | | | | |
|---|---|---|---|---|
| 3,252,225 | A | 5/1966 | Hixson | 33/205 |
| 4,314,365 | A | 2/1982 | Peterson et al. | 367/82 |
| 4,390,975 | A | 6/1983 | Shawhan | 367/82 |

(List continued on next page.)

FOREIGN PATENT DOCUMENTS

| | | |
|---|---|---|
| WO | WO 98/37465 | 8/1998 |

*Primary Examiner*—Timothy Edwards
(74) *Attorney, Agent, or Firm*—Todd E. Albanesi; Paul I. Herman

(57) ABSTRACT

A method and apparatus for data communication in an oil well environment, wherein the method comprises detecting an acoustic signal transmitted along an acoustic channel, the acoustic signal being distorted from transmission through the acoustic channel, generating a transmitted data signal in response to the acoustic signal, inputting the transmitted data signal to an adaptive equalizer and adaptively equalizing the transmitted data signal to produce an equalized data signal related to the transmitted data signal by a mathematical function. The detecting step may include positioning an acoustic receiver in a communication unit along the acoustic channel. The communication unit may be positioned downhole and the adaptive equalizer may be positioned remotely relative to the communication unit or may be placed in the communication unit. The adaptive equalizer may be a frequency domain filter, a neural net adaptive equalizer or a nonlinear recurrent neural net equalizer. The acoustic signal may comprise a plurality of discrete transmissions which may be a training sequence for training the adaptive equalizer and may comprise a first discrete transmission transmitted repeatedly.

The method of data communication in an oil well environment may comprise the steps of transmitting an acoustic signal from a first location along an acoustic channel, detecting the acoustic signal at a second location along the acoustic channel, generating a transmitted data signal in response to the acoustic signal, inputting the transmitted data signal to an adaptive equalizer and adaptively equalizing the transmitted data signal to produce an equalized data signal related to the transmitted data signal by a mathematical function. The transmitting step may further comprise positioning an acoustic transmitter in a first communication unit along the acoustic channel downhole or elsewhere. The method may further comprise acquiring data, generating an original data signal in response to the acquired data and inputting the original data signal to the acoustic transmitter. The acoustic signal may comprise a series of acoustic training signals for training the adaptive equalizer. The acoustic training signals may be transmitted at a predetermined time. A stored training signal may include a series of stored training data signals corresponding to the series of acoustic training signals. At least a portion of the stored training signals may be cross-correlated to the transmitted data signal. The acoustic signal may comprise a notification signal for notifying the adaptive equalizer of a training session.

64 Claims, 6 Drawing Sheets

U.S. PATENT DOCUMENTS

| | | | | |
|---|---|---|---|---|
| 4,562,559 | A | | 12/1985 | Sharp et al. ..... 367/82 |
| 4,992,997 | A | | 2/1991 | Bseisu ..... 367/82 |
| 5,050,132 | A | | 9/1991 | Duckworth ..... 367/82 |
| 5,124,953 | A | | 6/1992 | Grosso ..... 367/82 |
| 5,128,901 | A | | 7/1992 | Drumheller ..... 367/82 |
| 5,148,408 | A | | 9/1992 | Matthews ..... 367/82 |
| 5,151,882 | A | | 9/1992 | Kingman ..... 367/82 |
| 5,289,354 | A | | 2/1994 | Clayer et al. ..... 367/82 |
| 5,303,203 | A | | 4/1994 | Kingman ..... 367/75 |
| 5,321,981 | A | | 6/1994 | Macpherson ..... 73/151 |
| 5,373,481 | A | | 12/1994 | Orban et al. ..... 367/82 |
| 5,473,321 | A | * | 12/1995 | Goodman et al. ..... 340/854.9 |
| 5,479,440 | A | * | 12/1995 | Esfahani ..... 375/346 |
| 5,490,121 | A | * | 2/1996 | Gardner et al. ..... 367/83 |
| 5,504,121 | A | | 4/1996 | Doyle et al. ..... 340/854.9 |

* cited by examiner

ADAPTIVE ACOUSTIC CHANNEL EQUALIZER & TUNING METHOD

TECHNICAL FIELD

The present invention pertains to a system for transmitting acoustic data through a tubing string.

BACKGROUND OF INVENTION

There has been much interest in transmitting acoustic signals to and from locations in an oil well environment. The basic operating principal in acoustic signal transmission in a tubular media is to impart propagating stress waves into a pipe or tubing string which travel within the pipe to a distant location where transducers detect the signal which is then interpreted by the receiving equipment. In this way, data and signals can be transmitted via mechanical tubular transmission channels such as pipe or tubing.

There are many practical problems associated with using this scheme. When tubing, drill pipe or casing are used as an acoustic transmission channel, there is often significant signal distortion due to reflective interfaces in the channel such as tool joints, collars or other upsets. Additionally, there can be significant attenuation and interference associated with the fluid system within the wellbore and echos of the acoustic signals themselves within the wellbore. These factors significantly reduce the conditions under which acoustic data transmission may be effectively utilized. Acoustic data transmission may be limited by the distance of the transmission, the number and type of upsets in a drill string.

Efforts to effectively transmit data acoustically have often centered on careful control of the frequency and bandwidth of the transmission, the timing of the transmission and the duration of the transmission. U.S. Pat. No. 3,252,225 issued to Hixon and U.S. Pat. No. 4,314,365 issued to Petersen teach selection of transmission wave length based upon pipe characteristics such as the length of pipe sections and the overall length of the drill string. U.S. Pat. No. 4,390,975 issued to Shawhan suggests delaying successive acoustic data transmissions to allow reflections of earlier transmissions to dissipate. Similarly, U.S. Pat. No. 5,050,132 issued to Duckworth discloses transmissions of acoustic data signals only during preselected short time intervals to avoid data distortion. U.S. Pat. No. 5,124,953 issued to Grosso discloses selecting a passband frequency for acoustic data transmission that best correlates a measured and a modeled "power spectral density" of the acoustic transmission. U.S. Pat. No. 5,148,408 issued to Matthews similarly suggests the testing and finding of an optimum frequency for acoustic data transmission which results in the most efficient reception of the acoustic data under the circumstances then present in the well. The Matthews patent suggested period testing of data transmission through the drill string during drilling operations, finding an optimum frequency for transmission based upon drill string conditions at the time of testing, and changing the acoustic data transmission frequency as needed. U.S. Pat. No. 4,562,559 issued to Sharp et al, proposes a phase-shifted transmission wave having a broader frequency spectrum to bridge gaps in the passbands. U.S. Pat. No. 5,128,901 issued to Drumheller proposes transmission of acoustic data conditioned to counteract interference caused by the drill string. Prior to transmission, each signal frequency is multiplied by a factor designed to enhance data transmission.

In many communications systems it is possible to model the communication channel before the system is placed in service, then to design a channel equalizer to compensate for the channel distortion. Unfortunately, in an oil well the acoustic transmission environment changes continuously, so it is impossible to design a fixed acoustic channel equalizer which is tailored to the oil well environment. Further complicating acoustic equalization is the complex acoustic environment in an oil well which often contains non-linearities which cannot be effectively modeled using linear filtering techniques.

From the foregoing, it is apparent that a need exists for improved methods of acoustic data transmission and, in particular, a need exists for utilizing such improved methods of acoustic data transmission in oil well environments. Furthermore, it would be desirable to provide such methods which compensate for changes in the environments in which the acoustic data transmission occurs.

SUMMARY OF INVENTION

The invention is directed toward a method and apparatus for data communication in an oil well environment. The method comprises detecting an acoustic signal transmitted along an acoustic channel, the acoustic signal being distorted from transmission through the acoustic channel, generating a transmitted data signal in response to the acoustic signal, inputting the transmitted data signal to an adaptive equalizer and adaptively equalizing the transmitted data signal to produce an equalized data signal related to the transmitted data signal by a mathematical function. The detecting step may include positioning an acoustic receiver in a communication unit along the acoustic channel and the acoustic receiver may comprise at least one accelerometer. The communication unit may be positioned downhole and the adaptive equalizer may be positioned remotely relative to the communication unit or may be placed in the communication unit. The transmitted data signal may be in digital format. The adaptive equalizer may be a frequency domain filter, a neural net adaptive equalizer or a nonlinear recurrent neural net equalizer.

The acoustic signal may comprise a plurality of discrete transmissions which may be in binary code. The plurality of discrete transmissions may include a training sequence for training the adaptive equalizer and may comprise a first discrete transmission transmitted repeatedly.

In another embodiment, the method of data communication in an oil well environment may comprise the steps of transmitting an acoustic signal from a first location along an acoustic channel, detecting the acoustic signal at a second location along the acoustic channel, the acoustic signal being distorted from transmission through the acoustic channel, generating a transmitted data signal in response to the acoustic signal, inputting the transmitted data signal to an adaptive equalizer and adaptively equalizing the transmitted data signal to produce an equalized data signal related to the transmitted data signal by a mathematical function. The transmitting step may further comprise positioning an acoustic transmitter in a first communication unit along the acoustic channel downhole or elsewhere. The acoustic transmitter may comprise a piezoelectric stack acoustic wave generator or other transmission apparatus. Detection may further comprise positioning an acoustic receiver in a second communication unit in the drill string. As before, the adaptive equalizer may be a neural net adaptive equalizer.

The method may further comprise acquiring data, generating an original data signal in response to the acquired data and inputting the original data signal to an acoustic transmitter. Acquisition may comprise positioning a data acquisition unit along the drill string. The data acquisition unit comprises at least one data transducer such as a temperature sensor in communication with a downhole temperature source. The data acquisition unit may comprise a terminal capable of receiving data input.

The acoustic signal may comprise a series of acoustic training signals for training the adaptive equalizer. The series of acoustic training signals may be transmitted at a predetermined time. A stored training signal may be placed in storage and may include a series of stored training data signals corresponding to the series of acoustic training signals. At least a portion of the stored training signals may be cross-correlated to the transmitted data signal. The acoustic signal may comprise a notification signal for notifying the adaptive equalizer of a training session and the acoustic signal may be repeatedly transmitted during well operations.

DESCRIPTION OF THE DRAWINGS

Drawings of a preferred embodiment of the invention are annexed hereto, so that the invention may be better and more fully understood, in which.

Figure 1:
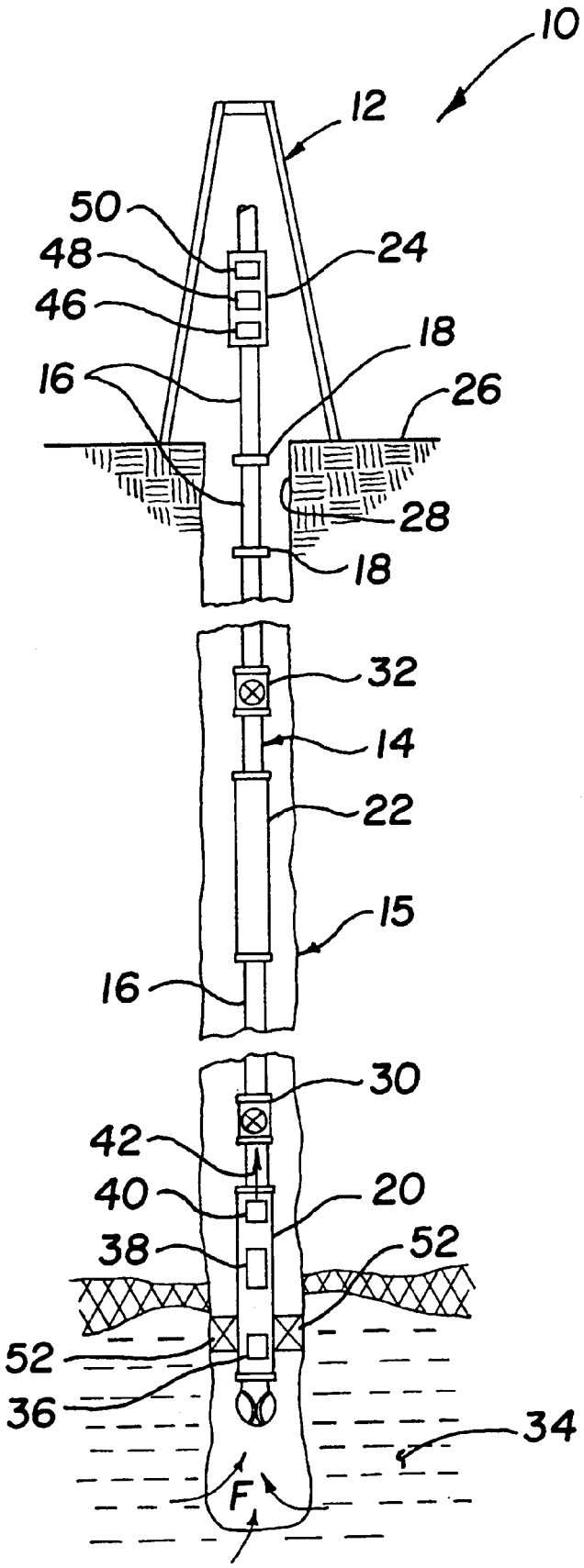
FIG. 1 is a cross-sectional elevational view of a downhole drilling apparatus and drill string.

Numeral references are employed to designate like parts throughout the various figures of the drawing. Terms such as "left," "right," "clockwise," "counter-clockwise," "horizontal," "vertical," "up" and "down" when used in reference to the drawings, generally refer to orientation of the parts in the illustrated embodiment and not necessarily during use. The terms used herein are meant only to refer to relative positions and/or orientations, for convenience, and are not to be understood to be in any manner otherwise limiting. Further, dimensions specified herein are intended to provide examples and should not be considered limiting.

DESCRIPTION OF A PREFERRED EMBODIMENT

FIG. 1 is a representational view of a typical downhole drilling apparatus 10. Above ground, a drilling rig 12 operates to support and drive a drill string 14. The drill string, tubing, and the well bore, the entire well itself comprise an acoustic channel 15 through which sound waves are propagated. The drill string 14 is often made up of a plurality of pipe sections 16 connected together by tool joints 18. The drill string 14 is used for operations within a wellbore 28 which may or may not bear casing along portions of its length. Depending on the circumstances at the well site, the drill string 14 may include valves, packers, subs, collars or other upsets. FIG. 1 shows communication units 20, 22 and 24 which may be placed on, in or near the drill string 14, below, at or above the surface 26, as shown. The communication units 20, 22 and 24 may be utilized for transmitting and receiving acoustic signals to and from locations within an oil well.

The signals may correspond to test data such as downhole pressure and temperature as measured during a draw down or build up test. The method may be used in non-testing situations as well, such as during drilling or production. Additionally, the communication unit may include any sensor which produces an output indicative of a stimuli as measured by the sensor, for example, temperature, pressure, pH, salinity, acceleration, speed, displacement, fluid flow rate, density, weight, etc. The sensor location is not limited to the communication unit but may be located on a sub, on or in a pipe section or joint, on or in the well bore or casing, or separately placed as necessary to sense the appropriate stimuli. The sensors may be suitably connected to electrical circuits for receiving the signals generated by the sensor and for converting the signals into a digital or other appropriate format for storage and manipulation by a suitable processor.

An apparatus and method of transmitting acoustic signals in an oil well is representatively illustrated in FIG. 1 as comprising a type of well test known as a drill stem test, wherein a transducer is utilized to determine the temperature and pressure in close proximity to a formation or production zone 34. In the method illustrated by the drill stem test, the communication unit 20 includes a well condition data acquisition means 36, most likely transducers, for measuring the pressure, temperature and/or flow rate of fluids F in the test zone. The apparatus and method described herein may be used during well operations of any sort, including drilling, testing, completion, and production. The drill stem test depicted in FIG. 1 is merely illustrative. The data acquisition means 36 is operably connected to a data conversion or manipulation unit 38 such that the well condition data may be received from the sensors and manipulated to produce a data signal. The data conversion and manipulation unit 38 may be an electrical circuit or computer for receiving the well condition data from the transducer or other sensors, converting the data into a digital or otherwise suitable signal, storing the data or signal, and transmitting the data signal. The communication unit 20 further includes an acoustic signal generator 40. The data signal is transmitted, preferably electronically, to the acoustic signal generator 40 which produces and emits a stress wave signal 42 corresponding to the data signal. The stress wave signal 42 is propagated up the acoustic channel, in this case the drill string 14, to a distant location for reception and interpretation. The acoustic signal generator 40 may include an actuator, such as a piezoelectric stack, a vibrator, or an oscillator, for creation of the stress wave signal 42.

The stress wave signal 42 is distorted by the filtering effect of the acoustic channel 15. Signal distortion occurs due to the reflective interfaces in the acoustic channel 15 such as the collars, tool joints 18, packers, such as packers 52, valves, such as valves 30 and 32, and other drill string equipment. Additionally, significant attenuation and interference of the stress wave data signal can be caused by the fluid system within the well bore 28. Additional "noise" may be caused by the bearings and the swivels at the top of the drill string, the rattling of chains against the kelley bushing, contact between the drill string and the well bore or casing, or by the motor in a top-drive drilling arrangement. Because of the interference and attenuation of the stress wave data signal in the acoustic channel 15, when the stress wave data signal is received at a distant location, such as communication unit 24 at the surface, the originally "clean" stress wave signal is significantly distorted.

The distorted stress wave signal 42 is received, in this instance, by communication unit 24, which acts as a receiver at the surface 26 of the well site. The communication unit 24 would include an acoustic receiver means 46, such as an accelerometer for detection of the now distorted stress wave signal 42. The distorted stress wave signal is converted to a distorted signal in digital or other appropriate form and transmitted to an adaptive equalizer 48.

The adaptive equalizer 48 restores the distorted signal to its original "clean" transmitted signal form so it may be properly interpreted. In essence, the equalizer 48 must be an inverse filter to the filtering effect of the tubing string 14. The adaptive equalizer may be linear or non-linear, recurrent or non-recurrent, and may be a fuzzy filter, a frequency domain filter, or, as preferred, a neural net filter. The restored clean signal can now be interpreted by a signal interpreter 50, so that the data which has been acoustically transmitted from communication unit 20 may be appropriately used in making determinations about well operations.

Figure 2:
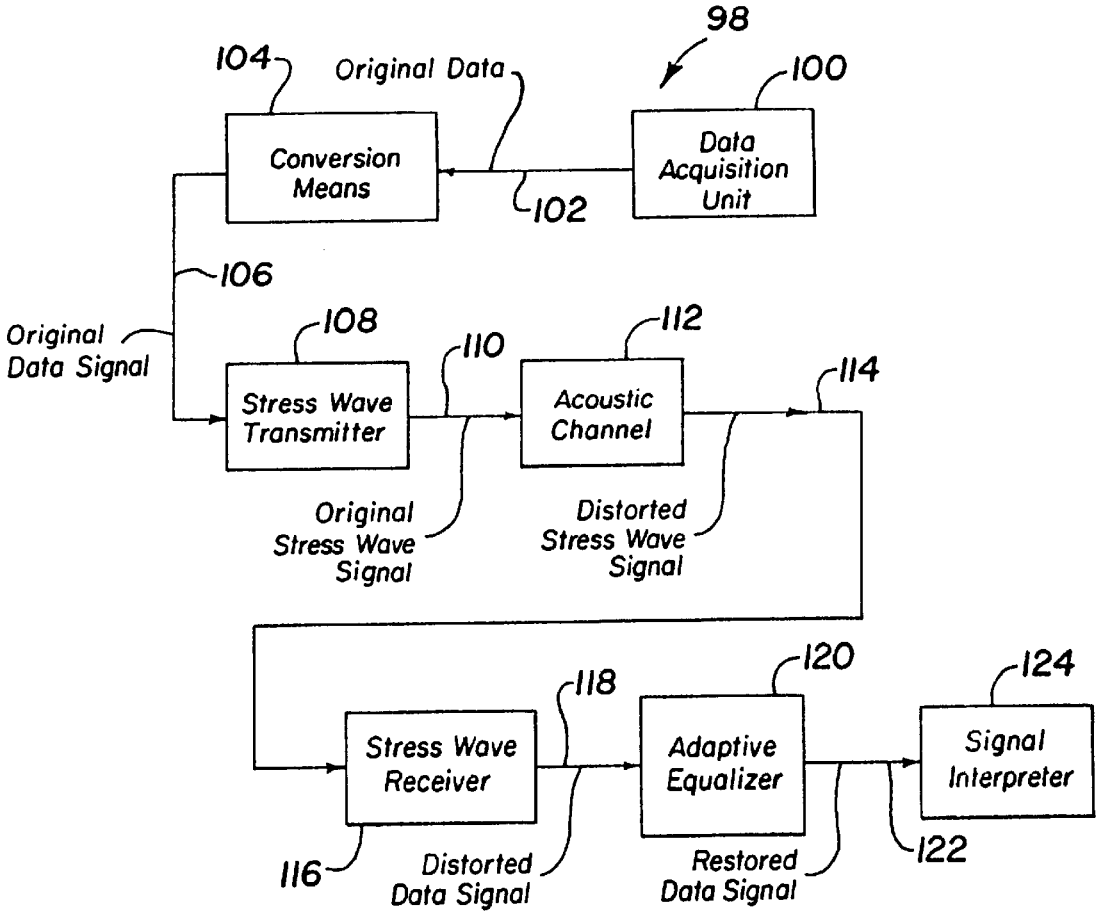
FIG. 2 is a component schematic of the method of acoustic transmission of data.

Referring to FIG. 2, a method 98 of acoustic data transmission is schematically and representatively illustrated in flow chart form. The data acquisition unit 100 collects and measures data about the well environment, such as pressure and temperature conditions downhole, or acts as a terminal and receives input from an outside source, such as a data sequence from a data input source.

The source of the initial data acquired by the data acquisition unit depends on the purpose of the acoustic data transmission. For example, a downhole communication unit, such as communication unit 20 or 22 in FIG. 1, may include one or more transducers or other sensors for measuring downhole well conditions such as pressure, temperature, well fluid rate, salinity, pH density or weight. The data measuring devices may be transducers, accelerometers or other sensors and may include power sources, electrical circuits, memory storage units, computers or other components as necessary. Further, data acquisition unit 100 may be remote from the communication unit depending on the particular circumstances at the well. That is, the pressure and temperature transducers, for example, may be placed in a sub for exposure to the well environment and transmit measured data to the communication unit.

A downhole data acquisition unit 100 may also monitor aspects of well equipment, either directly or indirectly. For example, appropriate instrumentation may directly monitor whether a valve, such as valve 30 or 32, is open or closed by measuring the position of the valve actuator or other valve element. Alternatively, acquisition of data on fluid flow or pressure at or near the valve may indirectly indicate the position of the valve. Similarly, acquired data may be used to indicate the operational status of downhole tools, collars, packers, tool joints, the drill string or any other well equipment.

Data may also be an input from an operator or other source at a surface communication unit such as communication unit 24. The surface communication unit 24 may receive input data which will be used to interrogate a downhole sensor or operate one or more downhole tools. The data input may come from a computer, sensor, other surface equipment or from a well field operator. For example, a computer or other mechanism containing a timer may submit a sequence of predetermined data for transmission downhole at various times, such as periodic requests for updates on downhole conditions or instructions to activate or deactivate various downhole tools or subs. Similarly, rig personnel may input a request for downhole environmental conditions at various times. It is understood that a data acquisition unit in a surface communication unit may also acquire measured data of well conditions, equipment status and the like. The method of data acquisition, input, and the substance of the data does not effect the use of the present invention.

The original data 102 output by the data acquisition unit 100 may be processed by a conversion means 104 into a digitized or otherwise readable original data signal 106. Appropriate electrical circuitry, computer, or other processing unit may be utilized to convert the electric or other form of raw data acquired from sensors, testing equipment or input source into a data signal 106 to be transmitted via the acoustic channel 15. The original or clean data signal is so-called because the signal has not yet been distorted by the attenuation and interference effects of the acoustic channel 15. The original data signal 106 may take any form which may then be converted into an acoustic or stress wave transmission. The data signal 106 may send any type of "message," whether an interrogatory to a distant transmitter receiver, information as to test data results, or commands to activate a well tool.

The "clean" original data signal 106 is transmitted as an original stress wave signal 110 into the acoustic channel 112, that is, the drill string, by a stress wave transmitter 108. The stress wave transmitter 108 converts the electrical, digitized or otherwise encoded original data signal 106 into a stress wave transmission 110, e.g., an acoustic signal, to be propagated to a distant location in the drill string or on the surface.

The stress wave transmitter 108 may transmit data as a sinusoidal stress, strain or displacement wave. The acoustic data signal, for example, could be propagated in binary code with a sinusoidal wave burst at a preselected frequency, such as 500 Hz, for a preselected duration, such as one second, representing a binary "1." Similarly, a binary "0" may be transmitted as a sinusoidal wave burst at a distinct frequency, such as 1000 Hz, for a duration of one second. The transmission of data in binary form is well understood. It is understood that the frequencies and burst durations are illustrative only and not critical to the practice of the invention. Frequencies and durations may be selected based on the circumstances of the well environment to provide the most easily detectable signals. Additionally, other methods of encoding data in stress waves may be employed, for instance, transmitting data based on a linear scale of frequency modulation or amplitude modulation. The encoding may take any form adequate to convey the information contained in the transmission, and the stress waves may be transmitted as axial, torsional or other types of waves. The mechanics of transmitting stress waves is well known in the art and the selected method is not critical here. The waves may be produced by a piezoelectric stack, a vibrator, an oscillator or any other suitable means. The original stress wave signal 110 is propagated into the acoustic channel 112 as a "clean" or clear signal. That is, the signal is not yet corrupted by attenuation in the drill string, interference from reflections, and masking by stress wave "noise" produced by other acoustic sources. The transmission finally detected by the acoustic receiver 116, therefore, is a distorted stress wave signal 114. The distorted stress wave signal 114 contains the data of the original transmission, but the data may initially be unrecognizable due to the distortions of the stress wave.

The acoustic channel 112 is the physical relay path along which the stress wave signal travels. The channel may be a drill string, casing, well string or any other suitable acoustic medium or a combination thereof. The drill string typically consists of numerous pipe sections 16 strung together by joints 18. The channel may also include collars, valves, subs, packers and various other well equipment. Each of these "upsets" cause reflections and attenuation of an acoustic signal transmitted into the channel. Additionally, the channel may be simultaneously transmitting unrelated acoustic waves, or noise, created by swivel joints, downhole or surface motors, compressors and the like, or by collisions between chains and the kelley bushing and other equipment.

The stress wave receiver 116, or acoustic receiver, detects the distorted stress wave signal 114 at a point distant from the acoustic transmitter 118. For example, the stress wave receiver 116 may be placed at the surface 26 as part of communication unit 24 for reception of transmitted signals regarding conditions at the well bottom transmitted from communications unit 20. Alternatively, the acoustic receiver may be placed downhole to receive transmissions from the surface, for example, interrogatories as to well conditions or tool status, or commands to activate a tool.

The acoustic receiver 116 relays the information contained in the distorted stress wave signal 114 to an adaptive equalizer 120 as a distorted data signal 118. The distorted data signal 118 is a digitized or otherwise usable "translation" of the distorted stress wave signal 114. The conversion of the signal may include the use of electric circuitry, memory storage devices, computers, recorders and the like. The distorted data signal 118, being a translation of the distorted acoustic transmission 114, will carry the attenuated, distorted data as detected by the receiver 116.

The distorted data signal 118 includes the encoded information of the original data signal 102. Problems arise in reading or interpreting that data, however, because the distorting effects of the acoustic channel may make the original data unreadable or unrecognizable. In the past, these distorting effects have limited the distances over which information could be relayed, dictated the time frame during which relays could occur and reduced the complexity of the data which could be transmitted. Alternatively, the distorting effects forced extended signal duration to overcome attenuation effects. Where acoustic transmission was difficult or impossible, a physical link, such as a wireline, had to be established between the transmitting and receiving communications units, with inherent difficulties and limitations.

The distorted data signal 118 is input into an adaptive equalizer 120. The preferred type of adaptive equalizer is a neural net, however, other types of adaptive equalizers may be employed, such as fuzzy filters or frequency domain filters, as are known in the art. Additionally, the adaptive equalizer may be linear, nonlinear, recurrent or non-recurrent. The preferred equalizer, as explained herein, is a nonlinear, recurrent neural network. The neural network may be a multi-layer perceptron network, that is, a network in which the sums of individually weighted inputs are output to at least one activation function, for example, log-sigmoid, symmetric saturating linear, hard limit, etc., within each layer. It is understood that other types of neural networks may be utilized.

The adaptive equalizer 120 is critical in the successful transmission of acoustic signals in a distorting acoustic channel such as present in most oil wells. The adaptive equalizer is capable of filtering out "noise" and distortions and isolating the acoustically transmitted data or signals even where the "noise" is variable. That is, whereas a non-adaptive equalizer may isolate a signal where the background noise and distortions are in steady state, an adaptive equalizer may isolate a signal where the noise distortions are in flux. The adaptive equalizer constantly adjusts to optimally equalize a distorted acoustic signal. The adaptive equalizer 120 is effectively an inverse filter to the filtering effect of the tubing string.

The adaptive equalizer 120, preferably a nonlinear neural net, may take many forms when used in actual practice to filter acoustically transmitted data. The neural network may exist virtually, such as when software is used to train a representation of the neural network on a computer. The neural network, or other adaptive equalizer, may be positioned in a communications unit, or an element thereof, such as an acoustic receiver. In such a case, the output of the receiver would be appropriately filtered at or near the reception site. Alternatively, the neural network may be positioned distant from the communications unit, such as in another portion of the well string or at the earth's surface. In that case, the equalization of the data signal would occur after the data left the communications unit. It is not necessary for the adaptive equalizer to be directly connected to the communications unit since any data transmission means may be used to provide communication therebetween and since the acoustic receiver output 118 may be stored for later input into a neural network. For example, a data recording device, such as a nonvolatile electronic memory, may be used to record the distorted data signal 118 and then later retrieved for analysis including input of the recorded data into the neural network.

The adaptive equalizer 120 must be "trained," as discussed herein, to appropriately filter or process the distorted data signal 118 transmitted from the acoustic receiver 116.

After equalization, a restored data signal 122 is transmitted to a signal interpreter 124. In practice, the interpreter may be in the same location, or be part of the same computer, software program or other computing device, as the adaptive equalizer. The interpreter may manipulate or otherwise process the data into a usable form, for example, translating a string of binary code into a computer read-out of pressure and temperature which can be easily read by a field worker.

The method described herein may be adapted to various purposes involving the transmission of data along a drill string via the propagation of stress waves. Acoustic signals may be transmitted or detected downhole or at the surface. For example, a downhole unit, such as unit 20, may employ a timer and transmitter, and periodically transmit an acoustic signal containing information on downhole conditions to a surface receiving unit 27. Similarly, the data acquisition unit in a downhole location, such as unit 20, may include emergency detection equipment. Upon detection of emergency conditions, such as catastrophic failure of downhole valve 30, the downhole emergency unit 20 could transmit a signal to communication unit 22 or 24 to close an upstream valve, such as valve 32.

Single communication units may include both transmission and receiving instruments (transceivers) and be capable of receiving and interpreting a signal transmitted from an originating unit responding to the data by initiating appropriate functions, and then transmitting a signal back to the originating unit. For example, a surface transceiver unit 24 may transmit an interrogatory to a downhole unit 20, or downhole units 20 and 22. The downhole transceiver units, upon detecting and interpreting the interrogatory, may transmit information on current or past downhole conditions in response to the interrogatory. Similarly, the surface transceiver may inquire as to tool status or direct a downhole unit to activate or deactivate a tool or sub. For example, the "message" may be to close valve 30. The downhole transceiver unit 20 would receive the signal, take appropriate action, namely closing the valve via appropriate communications and actuators, and possibly transmit confirming information back to the surface unit 24.

A plurality of transceiver units may be involved in the process. For example, unit 24 may transmit a first signal to downhole transceiver unit 20, unit 20 may then transmit a signal to transceiver unit 22, and finally return signals may be transmitted from units 20 and 22 to unit 24. Numerous arrangements and transfers may be utilized depending on the purposes of the transmissions.

The type of "message" transmitted, interrogatory, informational, or directive, is not limited by the invention. The subject matter is unlimited as well: environmental conditions, operational conditions,tool activation or deactivation signals, emergency signals, etc.

In practice most communications units will employ both transmitters and receivers. Not only does the transceiver arrangement enhance the utilization possibilities of the unit, it enables training of the adaptive equalizers in the system.

In order to train the adaptive equalizer, a training sequence must be transmitted to it on a regular basis. This allows the equalizer to "tune" itself until the training sequence is correctly interpreted. During training, the equalizer error, that is the difference between the equalizer output, and the known training sequence, is used to adjust the parameters in the mathematical functions of the equalizer until the error is minimized. For example, where the downhole communication unit 20 is designated to transmit downhole well condition information, such as pressure and temperature, to a surface communication unit 24, the adaptive equalizer 48 in the surface unit 24 must be trained prior to transmission of the environmental data. In a typical training method, the downhole unit 20 would transmit a preselected original training signal 212 at a preselected time to the surface unit 24. The adaptive equalizer 48, upon receiving the now distorted training signal 214, after propagation through the acoustic channel 14, would process the distorted signal 214 and produce an adaptive equalizer actual output 204. This actual output 204 may be "compared" to the desired result, namely the un-distorted, "clear" training signal 212 by finding the difference between the adaptive equalizer output 204 and a stored training signal 206. The stored training signal 206 is identical to the original training signal 212 (prior to distortion in the acoustic channel) and may be electronically stored for access by the equalizer 48. The difference between the desired output 204 and the stored training signal 206 is the error 208. The error 208 is used to adjust the parameters of the mathematical functions of the adaptive equalizer during repeated transmissions of the training signal 212 until the error 208 is minimized. After training, the output 204 of the adaptive equalizer will "match," or be similar to, the transmitted acoustic signal 212 from the downhole unit. Such training sequences may be transmitted between two or more communications units, or from or to downhole or surface units.

It is desirable that the equalizer have a "window" in time during which the training session will occur. That is, the equalizer may not be capable of distinguishing a transmitted signal from a lengthy random string of detected noise. Or the equalizer may mistakenly identify random noise as a transmitted signal and attempt to filter the meaningless noise. To eliminate these problems, the equalizer may be notified that training is commencing. A notification signal, preferably a clear unmistakable signal, may notify the equalizer that a training sequence is commencing. Alternately, the training sequence can be transmitted at preprogrammed times so the equalizer can independently (i.e. without notification from the transmitter) perform self-training with a known transmitted training sequence. This allows the equalizer to adaptively recover even if there is an abrupt change in the acoustic channel making coherent communication with the equalizer impossible during a portion of the training exercise. In this case, after enough training cycles are presented to the equalizer, normal signal transmission can commence.

Because there is an inherent delay in acoustic signal transmission which is subject to change from well to well, it is necessary to perform a cross-correlation between the preprogrammed training sequence in the adaptive equalizer and the received signal roughly corresponding to the predetermined time that the known training sequence will be transmitted. This cross-correlation allows the received training signal 212, and the pre-programmed stored training signal 206 to be "aligned" in time so that training will be possible. Although not necessary, it is preferred that the training sequence be transmitted to the equalizer frequently during a job, even as the tubing string is being assembled and placed in the well if possible. A regimen of frequent training exercises insures that the equalizer adapts to acoustic changes in the well string caused by additions, removal, or movement of well tools and well fluids.

Methods of network training are described in copending U.S. patent application Ser. No. 09/298,691 [HAL. 990115] by Roger Schultz, which is incorporated herein by reference in its entirety.

Figure 3:
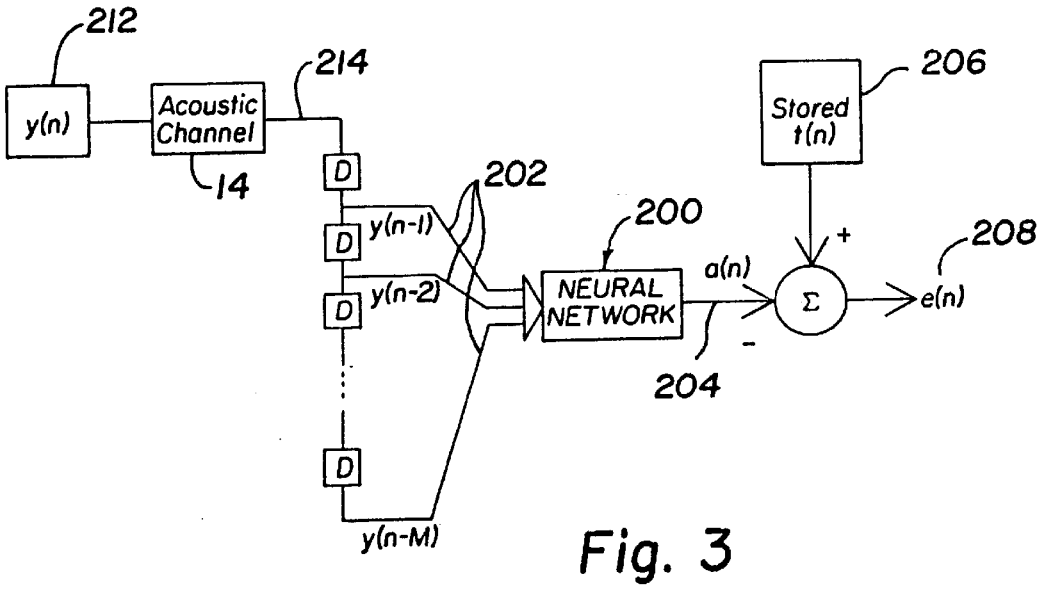
FIG. 3 is a schematic flow chart of a non-recurrent real-time neural network.

Preferably, the adaptive equalizer is a neural network. Network training can be accomplished using an approximate steepest descent method. At each time-step the measured error is used to calculate a local gradient estimation which is used to update the network weights. Recurrent and non-recurrent networks must be trained using separate methods for calculating the cost function gradient, which is used in the approximate steepest descent method of training. For networks which are non-recurrent (i.e. having no feedback), standard back propagation may be used to calculate the necessary gradient terms used in training. FIG. 3 shows a basic non-recurrent real-time network 200 in flow chart form. The chart also shows the system inputs 202, outputs 204, and the pre-selected stored training signal 206 which are used in training the network. The received original training signal 212 is represented as y(n). The system inputs 202 are a plurality of received training signals, designated by a series of signal indications (y(n−1), y(n−2), . . . , y(n−M)) separated by time delays (D). The time delays may or may not be equal. The actual equalizer output 204 is designed by a(n). The error e(n) 208 in FIG. 3 is the difference between the desired network output, the stored training signal 206, designated by t(n), which is identical to the original training signal 212, and the actual network output 204. In a predictive signal processing system the prediction error is calculated as the difference between the measured signal sample, and it's previously computed prediction. These computed errors are used to adjust the neural network weights to minimize the signal prediction error 208.

Figure 4:
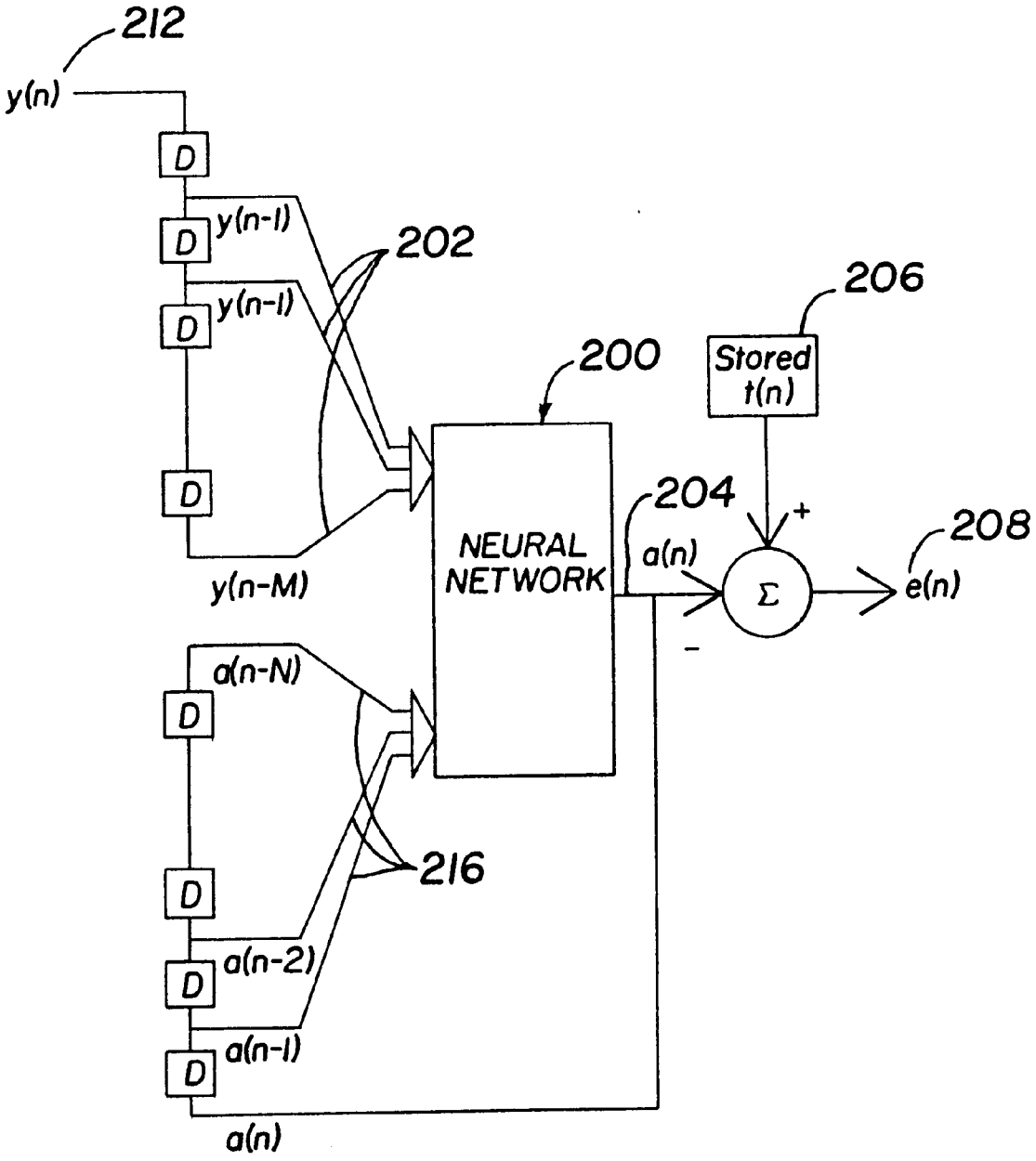
FIG. 4 is a schematic flow chart of a recurrent real-time neural network.

For recurrent networks in which delayed values of the output are fed back as input to the network, a different method of calculating the derivative of the network output with respect to the weights must be used. This is necessary because when a feedback path is present the current output is always a function of the past output. FIG. 4 shows a basic recurrent network with the actual network output a(n) 204 fed back into the neural network as a series of feedback inputs 216, represented by series of signal indications (a(n), a(n−1), a(n−2), . . . , a(n−N)). A method of dynamic back propagation may be used to calculate the gradient for use in weight adjustment. Specifically, the forward perturbation method may be employed to calculate derivatives.

Figure 5:
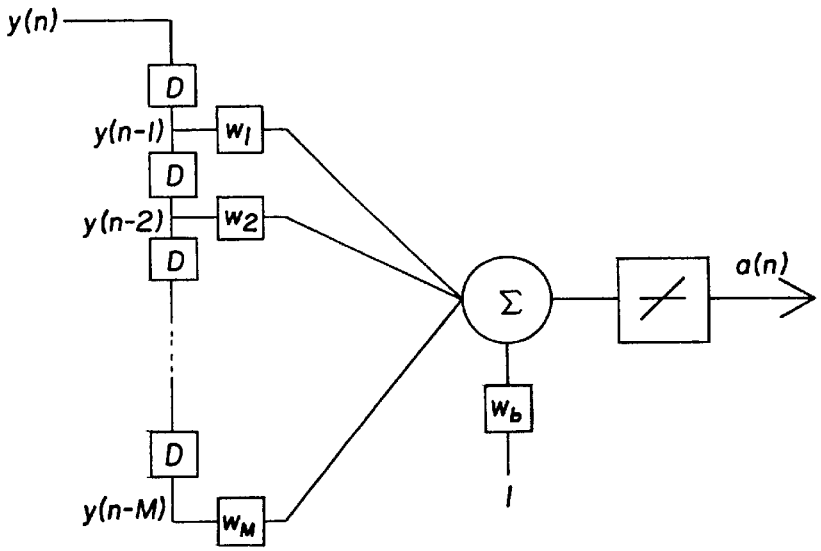
FIG. 5 is a schematic flow chart of a linear non-recurrent neural network.
Figure 6:
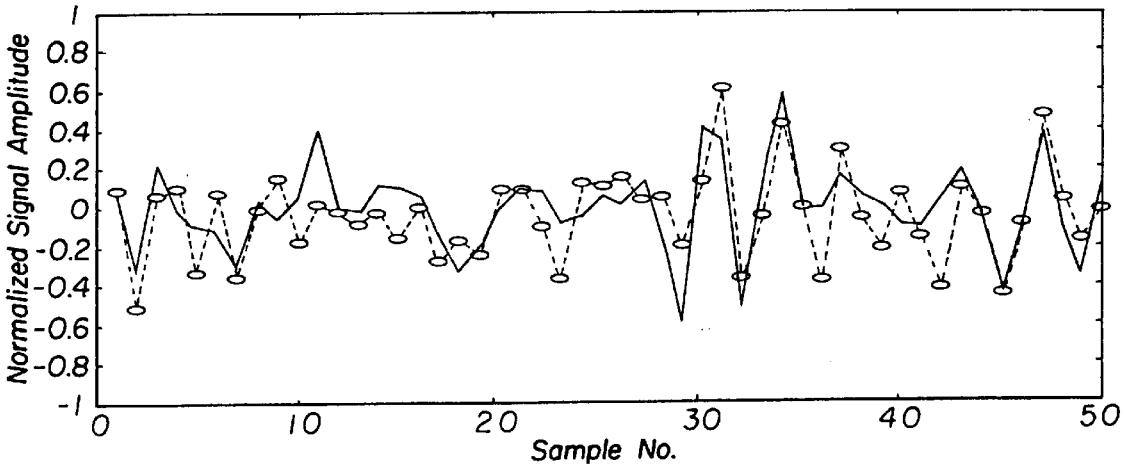
FIG. 6 is a data prediction chart for an experiment utilizing a linear non-recurrent neural network.

Several different network structures will be considered. The more complicated network structures which are non-linear or recurrent or both will provide improved performance in many instances over the simple linear non-recurrent network of FIG. 3. In order to illustrate the enhanced capabilities of the more complicated networks, four different network structures have been used to predict, one step in advance, some experimental data. As a base line, the first network which will be considered has a simple linear non-recurrent structure. The network and test results are shown in FIGS. 5 and 6. As FIG. 5 shows, this network is a single layer network containing no feedback, which utilizes a linear activation function. The test results in FIG. 6 chart the predicted and actual normalized signal amplitude over a sample range. As in FIGS. 8 and 10, the dashed lines represent the predicted signal amplitude while the solid lines indicate the true signal amplitude. The prediction of experimental data, as shown in FIG. 6, yielded a base-line prediction accuracy as measured by a squared prediction error, of 2.07.

The first type of nonlinear network which was evaluated has a non-recurrent two-layer structure, which contains nonlinear log-sigmoid functions of the form:

$$f(n) = \frac{1}{1 + e^{-n}}$$

Figure 7:
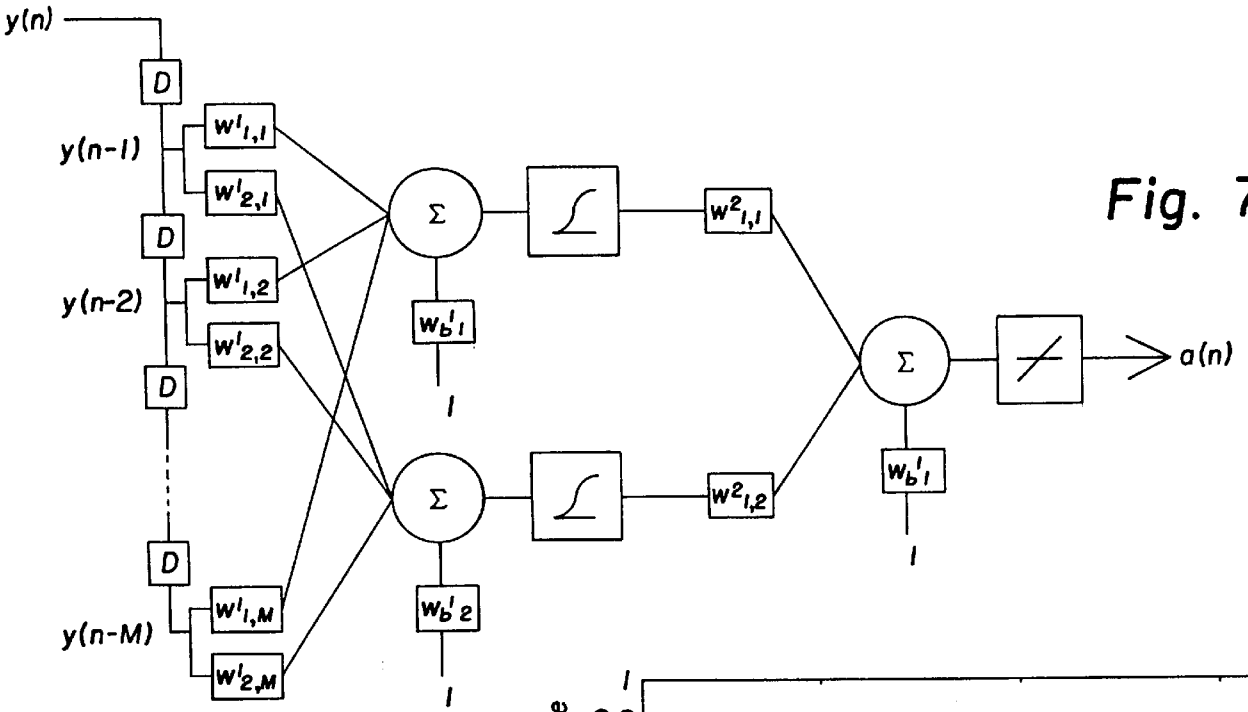
FIG. 7 is a schematic flow chart of a non-linear non-recurrent neural network.
Figure 8:
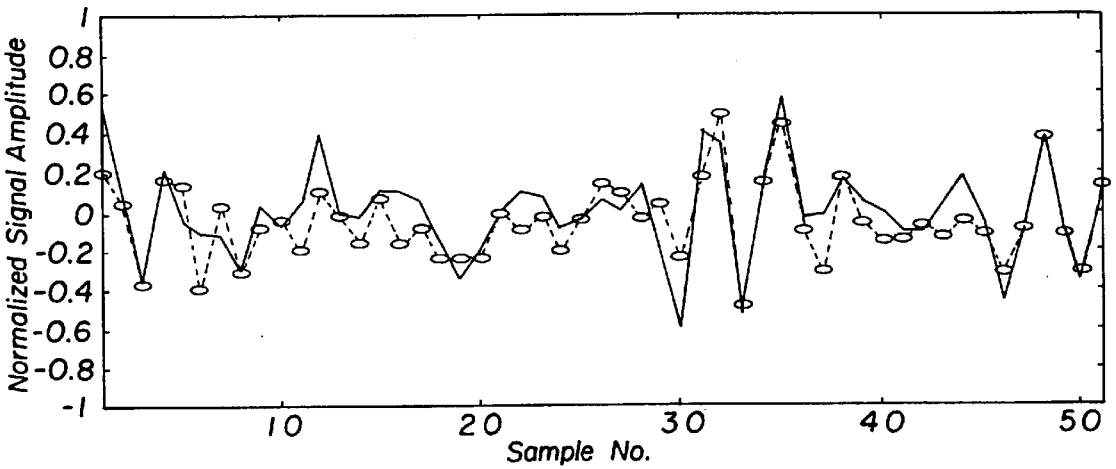
FIG. 8 is a data prediction chart for an experiment utilizing non-linear non-recurrent neural network.

FIGS. 7 and 8 show the network and the prediction results. A fairly dramatic improvement in prediction accuracy can be seen with this network. As FIG. 8 shows, the squared predicted error dropped to 1.23 for the non-linear non-recurrent two-layer network indicated in FIG. 7.

Figure 9:
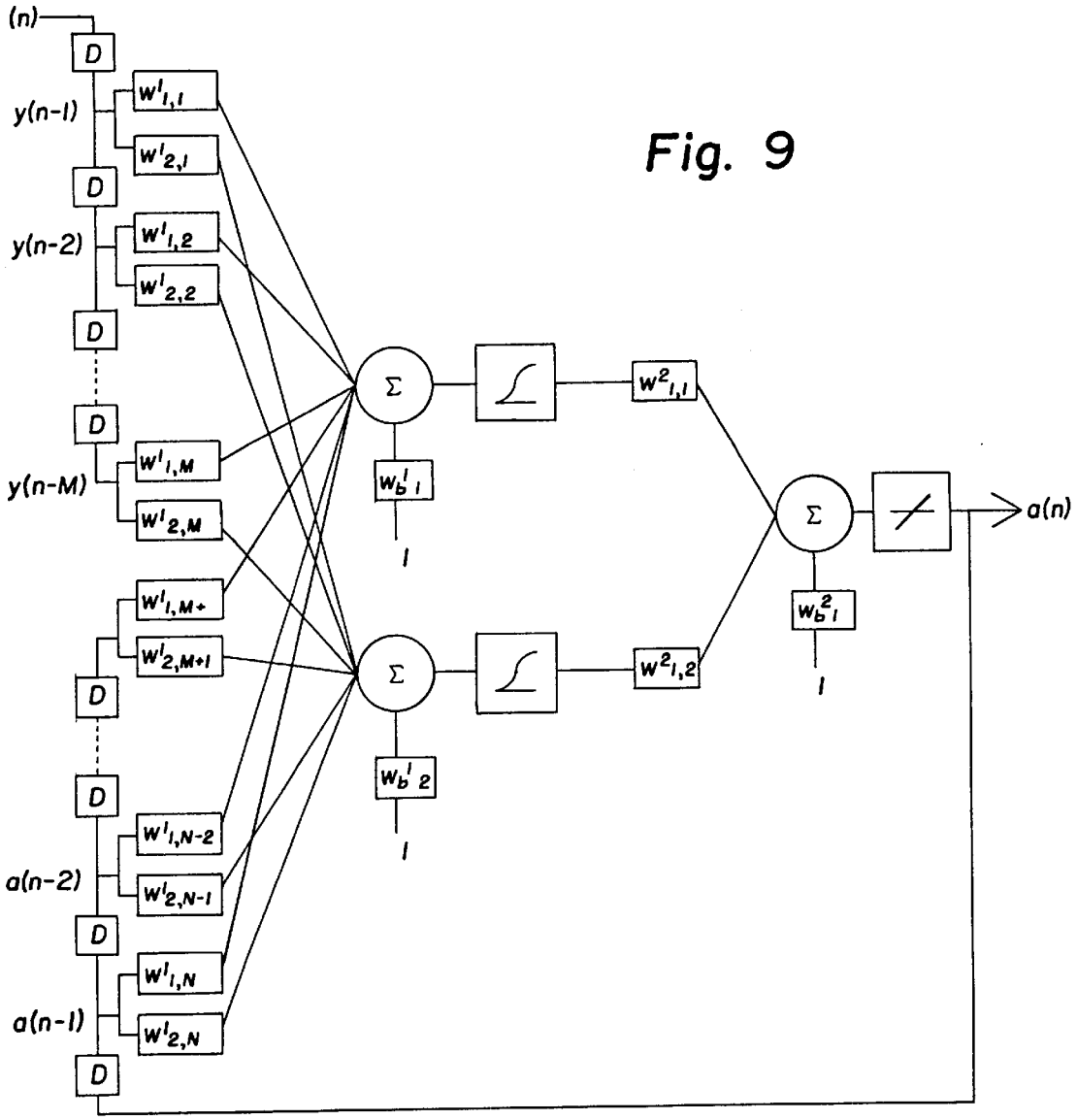
FIG. 9 is a schematic flow chart of a non-linear recurrent neural network.
Figure 10:
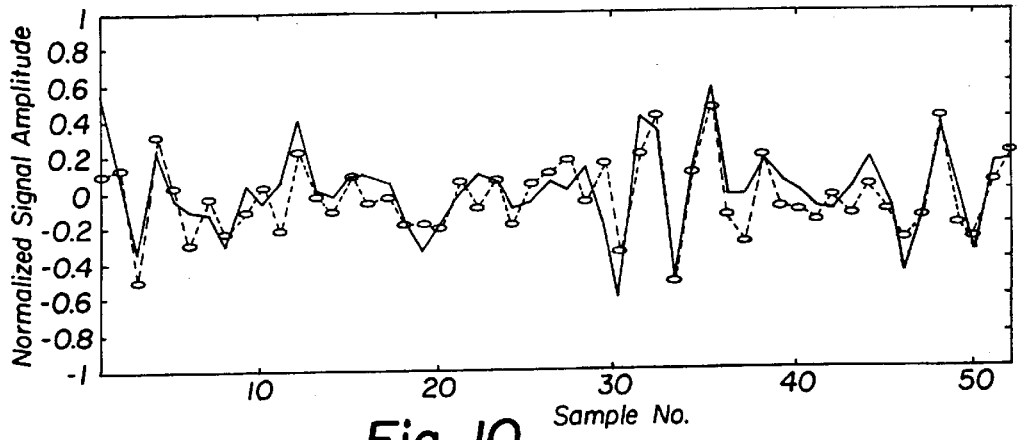
FIG. 10 is a data prediction chart for an experiment utilizing a non-linear recurrent neural network.

FIGS. 9 and 10 show a fully recurrent nonlinear network and the prediction results. The nonlinear recurrent network shown in FIG. 9 is similar to the network of FIG. 7 with one key difference. A feedback loop is present which fills a tapped delay line with past network outputs, which are used as input to the network. This network is most complicated to implement, but provides the best prediction performance. As seen in FIG. 10, the squared prediction error dropped to 1.15 for the experiment employing the non-linear recurrent network of FIG. 9. All networks utilized a 70-tap delay line for inputs, and the recurrent networks used a 10-tap delay for the recurrent inputs. The results shown in FIGS. 6, 8 and 10 indicate that using nonlinear prediction techniques provides better performance than conventional linear prediction techniques.

After careful consideration of the specific and exemplary embodiments of the present invention described herein, a person skilled in the art will appreciate that certain modifications, substitutions, and other changes may be made without substantially deviating from the principles of the present invention. The detailed description is to be understood as being illustrative, the spirit and scope of the present invention being limited solely by the appended claims.

We claim:

1. A method of data communication in an oil well environment, the method comprising the steps of:

detecting an acoustic signal transmitted along an acoustic channel, the acoustic signal being a wave burst at a pre-selected frequency for a pre-selected duration, the acoustic signal being distorted from transmission through the acoustic channel;

generating a transmitted data signal in response to the acoustic signal;

inputting the transmitted data signal to an adaptive equalizer; and adaptively equalizing the transmitted data signal to produce an equalized data signal related to the transmitted data signal by a mathematical function.

2. A method as in claim 1 wherein the transmitted data signal is in digital format.

3. A method as in claim 1 wherein the adaptive equalizer is a frequency domain filter.

4. A method as in claim 1 wherein the adaptive equalizer is a neural net adaptive equalizer.

5. A method as in claim 4 wherein the neural net adaptive equalizer is a nonlinear recurrent neural net equalizer.

6. A method as in claim 1 wherein the acoustic signal comprises a plurality of discrete transmissions.

7. A method as in claim 6 wherein each discrete transmission comprises binary code.

8. A method as in claim 6 wherein the plurality of discrete transmissions comprises a training sequence for training the adaptive equalizer.

9. A method as in claim 1 wherein the detecting step further comprises positioning an acoustic receiver in a communication unit along the acoustic channel.

10. A method as in claim 9 wherein the acoustic receiver comprises at least one accelerometer.

11. A method as in claim 9 wherein the positioning step further comprises positioning the communication unit downhole.

12. A method as in claim 9 wherein the positioning step further comprises remotely positioning the adaptive equalizer relative to the communication unit.

13. A method as in claim 9 wherein the positioning step further comprises placing the adaptive equalizer in the communication unit.

14. A method as in claim 13 wherein the adaptive equalizer is a neural net adaptive equalizer.

15. A method as in claim 14 wherein the plurality of discrete transmissions comprises a first discrete transmission transmitted repeatedly.

16. A method of data communication in an oil well environment, the method comprising the steps of:

transmitting an acoustic signal from a first location along an acoustic channel, the acoustic signal being a wave burst at a pre-selected frequency for a pre-selected duration;

detecting an acoustic signal at a second location along the drill string, the acoustic signal being distorted from transmission through the acoustic channel;

generating a transmitted data signal in response to the acoustic signal;

inputting the transmitted data signal to an adaptive equalizer; and adaptively equalizing the transmitted data signal to produce an equalized data signal related to the transmitted data signal by a mathematical function.

17. A method as in claim 16 wherein the adaptive equalizer is a neural net adaptive equalizer.

18. A method as in claim 16 wherein the acoustic signal comprises a plurality of discrete transmissions.

19. A method as in claim 18 wherein each discrete transmission comprises binary code.

20. A method as in claim 18 wherein the plurality of discrete transmissions comprises a first discrete transmission transmitted repeatedly.

21. A method as in claim 16 wherein the detecting step further comprises positioning an acoustic receiver in a second communication unit in the acoustic channel.

22. A method as in claim 21 wherein the second location is downhole.

23. A method as in claim 21 wherein the receiver comprises at least one accelerometer.

24. A method as in claim 21 wherein the adaptive equalizer is positioned remotely relative to the acoustic receiver.

25. A method as in claim 16 wherein the transmitting step further comprises positioning an acoustic transmitter in a first communication unit along the acoustic channel.

26. A method as in claim 25 wherein the acoustic transmitter comprises a piezoelectric stack acoustic wave generator.

27. A method as in claim 25 wherein the first location is downhole.

28. A method as in claim 27 wherein the second location is downhole.

29. A method as in claim 16 further comprising the step of:

acquiring data;

generating an original data signal in response to the acquired data; and inputting the original data signal to an acoustic transmitter.

30. A method as in claim 29 wherein the acquiring step further comprises positioning a data acquisition unit along the acoustic channel.

31. A method as in claim 30 wherein the data acquisition unit comprises a terminal capable of receiving data input.

32. A method as in claim 30 wherein the data acquisition unit comprises at least one data transducer.

33. A method as in claim 32 wherein at least one of the data acquisition transducers comprises a temperature sensor in communication with a downhole temperature source.

34. A method as in claim 16 wherein the acoustic signal comprises a series of acoustic training signals for training the adaptive equalizer.

35. A method as in claim 34 wherein the acoustic signal further comprises a notification signal for notifying the adaptive equalizer of a training session.

36. A method as in claim 34 wherein the acoustic signal is repeatedly transmitted during well operations.

37. A method as in claim 34 further comprising the step of placing in storage a stored training signal, the stored training signal comprising a series of stored training data signals corresponding to the series of acoustic training signals.

38. A method as in claim 37 wherein the adaptive equalizer is a neural net adaptive equalizer.

39. A method as in claim 34 wherein the series of acoustic training signals are transmitted at a predetermined time.

40. A method as in claim 39 further comprising cross-correlating at least a portion of the stored training signals and the transmitted data signal.

41. An oil well data communication apparatus comprising:

a first communication unit at a first location along an acoustic channel, the communication unit having, an acoustic receiver for detecting an acoustic signal transmitted along the acoustic channel, the acoustic signal being a wave burst at a pre-selected frequency for a pre-selected duration, the acoustic receiver operable connected to an acoustic data converter for generating a transmitted data signal in response to the acoustic signal and an adaptive equalizer capable of producing an equalized data signal related to the transmitted data signal by a mathematical function where the transmitted data signal is input to the adaptive equalizer.

42. An apparatus as in claim 41 wherein the location of the communication unit is downhole.

43. An apparatus as in claim 41 wherein the acoustic receiver comprises at least one accelerometer.

44. An apparatus as in claim 41 wherein the adaptive equalizer is located in the communication unit.

45. An apparatus as in claim 41 wherein the adaptive equalizer is a frequency domain filter.

46. An apparatus as in claim 41 wherein the adaptive equalizer is a neural net adaptive equalizer.

47. An apparatus as in claim 46 wherein the neural net adaptive equalizer is a nonlinear recurrent neural net adaptive equalizer.

48. An apparatus as in claim 41 further comprising a second communication unit at a second location along the acoustic channel, the second location remote from the first location, the second communication unit having an acoustic transmitter for transmitting the acoustic signal along the acoustic channel.

49. An apparatus as in claim 48 wherein the second location is downhole.

50. An apparatus as in claim 48 wherein the acoustic transmitter comprises a piezoelectric stack acoustic wave generator.

51. An apparatus as in claim 48 wherein the acoustic signal comprises a plurality of discrete transmissions.

52. An apparatus as in claim 51 wherein each discrete transmission comprises binary code.

53. An apparatus as in claim 51 wherein the plurality of discrete transmissions comprises a repetition of a first discrete transmission.

54. An apparatus as in claim 48 wherein the acoustic signal comprises a series of acoustic training signals for training the adaptive equalizer.

55. An apparatus as in claim 54 wherein the series of acoustic training signals are transmitted at a predetermined time.

56. An apparatus as in claim 54 wherein the second communication unit further comprises a data storage device for storing a stored training signal, the stored training signal comprising a series of stored training data signals corresponding to the series of acoustic training signals.

57. An apparatus as in claim 54 wherein the acoustic signal further comprises a notification signal for notifying the adaptive equalizer of a training session.

58. An apparatus as in claim 54 wherein the acoustic signal is repeatedly transmitted during well operations.

59. An apparatus as in claim 48 further comprising a data acquisition unit for the collection of acquired data.

60. An apparatus as in claim 59 wherein the data acquisition unit is located in the second communication unit.

61. An apparatus as in claim 59 wherein the data acquisition unit comprises an acquired data converter capable of generating an acquired data signal in response to the acquired data, the acquired data signal for input to the acoustic transmitter.

62. An apparatus as in claim 59 wherein the data acquisition unit comprises at least one data transducer.

63. An apparatus as in claim 62 wherein at least one of the data transducers comprises a temperature sensor in communication with a downhole temperature source.

64. An apparatus as in claim 62 wherein the data acquisition unit comprises a terminal capable of receiving data input.

* * * * *